US006070753A

United States Patent [19]

Hirst et al.

[11] Patent Number: 6,070,753

[45] **Date of Patent: *Jun. 6, 2000**

[54] LIQUID CONTAINER

[75] Inventors: Richard N. Hirst, Teaneck, N.J.; Herbert M. Meyers, New Rochelle; Richard C. Edstrom, New York, both of N.Y.; Richard G. Kraft, Joliet, Ill.

[73] Assignee: Exxon Research and Engineering Co., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/017,354

[22] Filed: Feb. 2, 1998

[51] Int. Cl.[7] ..... B65D 1/42

[52] U.S. Cl. ..... 220/674; 220/675; 215/40; 222/478

[58] Field of Search ..... 220/669, 674, 220/675; 215/40, 41, 42; 222/478

[56] References Cited

U.S. PATENT DOCUMENTS

| | | | |
|---|---|---|---|
| D. 137,943 | 5/1944 | Schlumbohm | 215/40 |
| D. 282,634 | 2/1986 | Beaver et al. | D9/375 |
| D. 282,635 | 2/1986 | Beaver et al. | D9/376 |
| D. 282,636 | 2/1986 | Beaver et al. | D9/376 |
| D. 289,376 | 4/1987 | Nemits | D9/375 |
| D. 295,955 | 5/1988 | LeFevre | D9/375 |
| D. 301,306 | 5/1989 | Beaver | D9/375 |
| D. 303,628 | 9/1989 | Beaver | D9/375 |
| D. 304,159 | 10/1989 | Kleinert | D9/375 |
| D. 309,100 | 7/1990 | Beaver | D9/375 |
| D. 337,946 | 8/1993 | Bridger et al. | D9/523 |
| D. 352,904 | 11/1994 | Kearse et al. | D9/523 |
| 1,421,696 | 7/1922 | Kucera | 215/40 |
| 4,349,119 | 9/1982 | Letica | 220/306 |
| 4,518,097 | 5/1985 | Milton et al. | 220/307 |
| 4,838,464 | 6/1989 | Briggs | 215/40 |
| 4,949,861 | 8/1990 | Cochran | 215/42 |
| 5,067,622 | 11/1991 | Garver et al. | 215/1 C |
| 5,202,078 | 4/1993 | Moore | 264/527 |
| 5,217,128 | 6/1993 | Stenger | 215/1 C |

OTHER PUBLICATIONS

U.S. Trademark Registrations and Applications: Serial Nos. 73–665,817, 74–254,052, 74–283,653, 74–396,027, 73–613,133, 73–655,594, 74–056,305, 74–122,010, 74–698,983, 73–535,900, 74–122,011, 74–122,016, 74–122,017, 74–122,019.

Color copies of slides depicting present day containers for motor oils under the following brand names: (1) Exxon; (2) Quaker State; (3) Pennzoil; (4) Quaker State, Valvoline, Pennzoil and Castrol; (5) Havoline, Amoco, Sunoco, Citgo, Mobil, Exxon; (6) Mobil and Coastal; (7) Valvoline; (8) Mobil and Pennzoil; (9) Havoline, Motorcraft, Mobil and AC–Delco.

*Primary Examiner*—Joseph M. Moy
*Attorney, Agent, or Firm*—Fulbright & Jaworski L.L.P.

[57] ABSTRACT

A container holds fluids, such as motor oil, and is sized to hold about one quart or one liter. The container has a rectangular base portion, and a top portion is formed integral with the base portion, the top portion being shaped like an offset, inverted funnel. The top portion has an opening forming a mouth, an outside edge of the mouth being in substantial alignment with a first side of the base portion. A concave, arcuate top panel extends from an opposing second side of the base portion to the mouth, and the top panel has a ridge along the center of its length for increasing top load strength and for providing a flow channel for fluid within the container.

33 Claims, 2 Drawing Sheets

FIG. 1
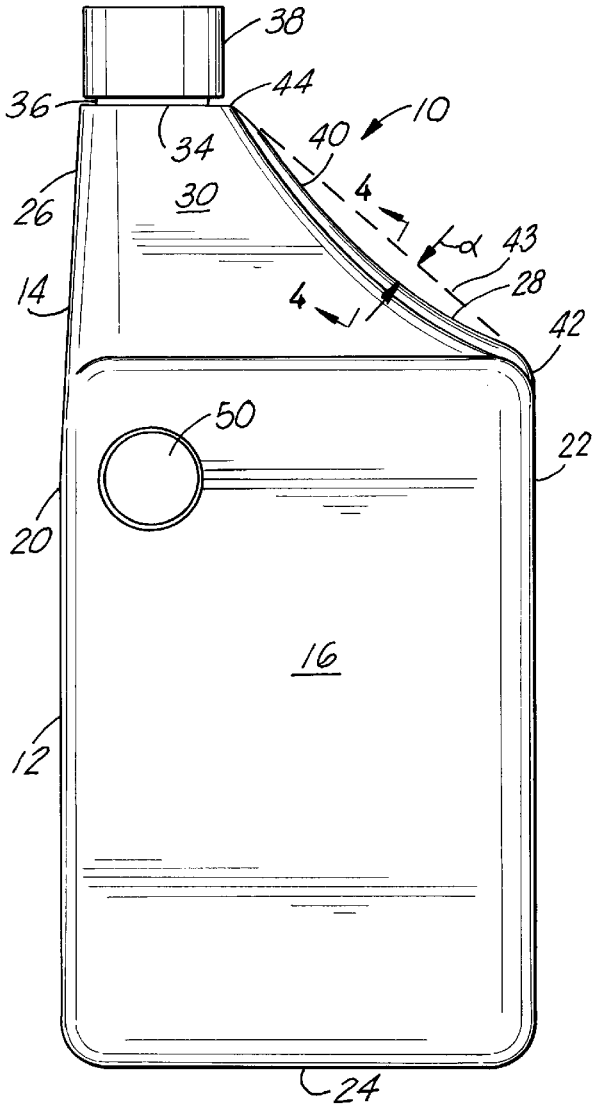
FIG. 2
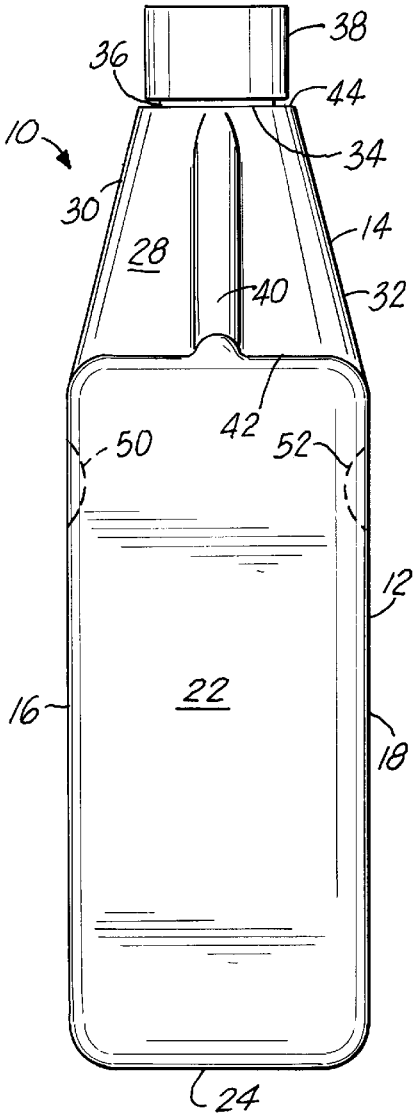
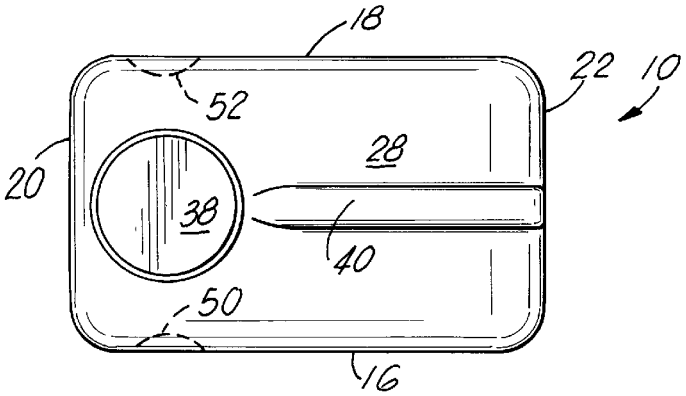
FIG. 3

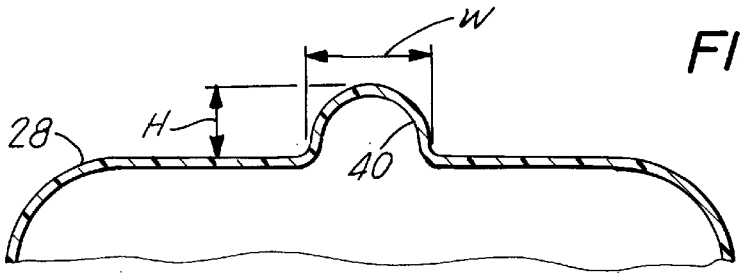
FIG. 4
FIG. 5
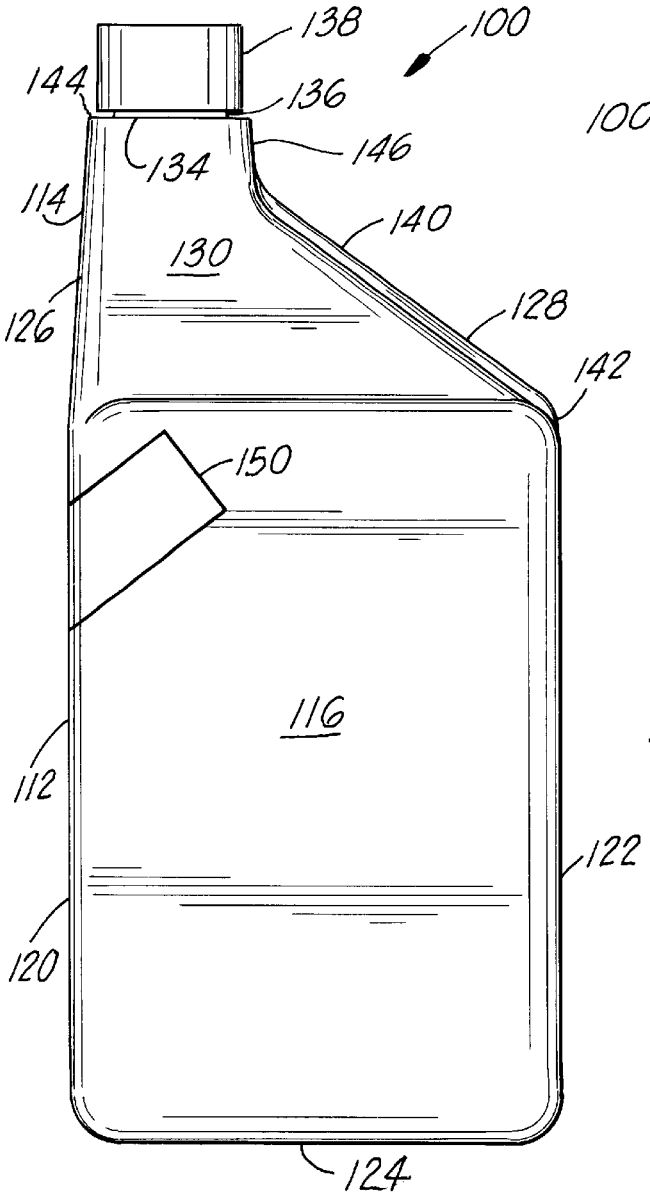
FIG. 6
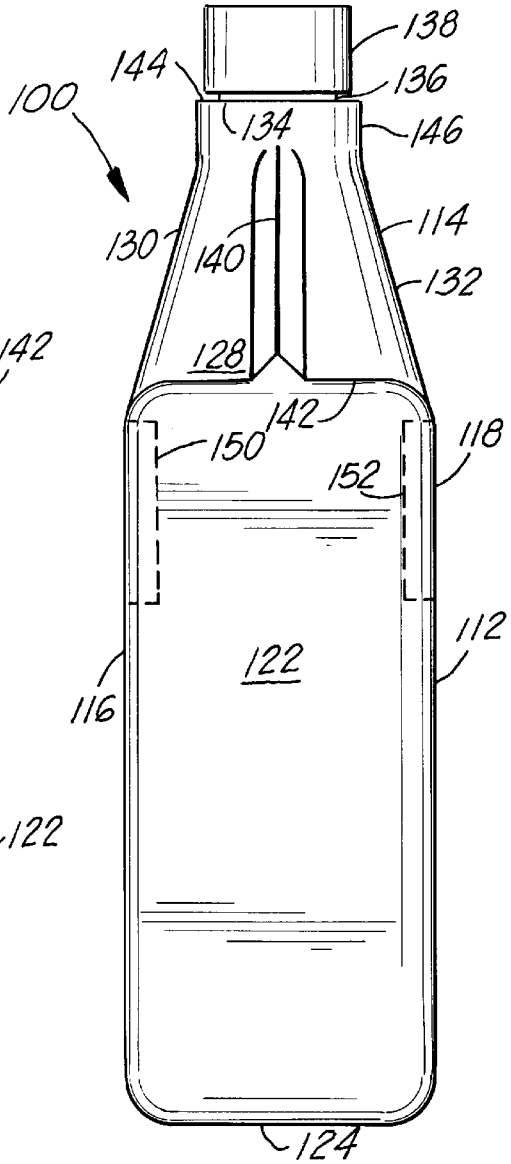

LIQUID CONTAINER

BACKGROUND OF THE INVENTION

1. Field of the Invention

The present invention relates to a container. More particularly, the present invention relates to a liquid container.

2. Description of the Related Art

Plastic bottles have been used as liquid containers for motor oil, automatic transmission fluid and the like. Typically, the containers hold about one quart or one liter of liquid and are closed by a threaded cap. The containers typically have had a rectangular footprint, usually because this provides an efficient configuration for packing in cartons and on shelves. Variations have occurred in portions of the container to improve packaging and displaying. In spite of the variations, there remains a need for functional improvements, particularly to improve its strength and handling.

SUMMARY OF THE INVENTION

A container is provided having an elongated and sweeping top and neck portions leading into a mouth that is offset towards a first side of the container. A top panel sweeps upward along a concave, arcuate path from a second side of the container to the mouth. A ridge runs the length of the top panel along a center line. The ridge provides structural strength for top load compression resistance, and it also provides a flow channel to drain fluid more efficiently from the container. Recesses provided in an upper portion of front and back panels towards the first side provide a grip for grasping the container and indicate a preferred manner for holding the container.

BRIEF DESCRIPTION OF THE DRAWINGS

A better understanding of the present invention can be obtained when the following detailed description of the invention is considered in conjunction with drawings described as follows:

FIG. 1 is a front elevation of a container according to the present invention.

FIG. 2 is a side elevation of the container of FIG. 1.

FIG. 3 is a top view of the container of FIG. 1.

FIG. 4 is a cross section of a portion of the present invention taken along the line 4—4 of FIG. 1.

FIG. 5 is a front elevation of a container illustrating an alternative embodiment of the present invention.

FIG. 6 is a side elevation of the container of FIG. 5.

DETAILED DESCRIPTION OF THE PRESENT INVENTION

With reference to FIGS. 1–3, a container 10 is illustrated according to the present invention. High density polyethylene is used typically to make container 10, although other materials can be used. Container 10 is formed integrally for leak-proof (containment of a fluid such as motor oil or automatic transmission fluid, although it is suitable for holding other fluids or flowable solids. Container 10 is made preferably by extrusion blow molding, but can be made by other processes, such as injection molding, well known to one skilled in the art.

Container 10 has a base portion 12 and a top portion 14. Base portion 12 includes a front panel 16, a back panel 18 which is symmetrical with front panel 16, a first side panel 20 and an opposing second side panel 22. A bottom panel 24 forms a base for container 10.

Top portion 14 is shaped like an inverted funnel with an offset opening. Top portion 14 has a first wall 26 which is integral with and substantially in vertical alignment with first side panel 20. A second wall 28 opposes first wall 26. Second wall 28 has a (concave, arcuate shape. A front wall 30 and a back wall 32, which is symmetrical to front wall 30, are formed integral with first wall 26 and second wall 28 and with base portion 12. Top portion 14 has an opening 34 forming a mouth for container 10. A cap receiving portion 36 surrounds opening 34 and is formed integral with top portion 14 and has male threads for receiving a cap 38.

A ridge 40 is formed in second wall 28. Second wall 28 merges with second side panel 22 at a transition corner 42. Second wall 28 terminates at an upper end at a ledge 44 which is adjacent to opening 34. Ridge 40 runs along the length of second wall 28 between transition corner 42 and ledge 44 and is essentially centered between front wall 30 and back wall 32.

With reference to FIG. 4, ridge 40 has a transverse cross section shaped like an inverted U, as viewed from the outside of container 10. However, as viewed from the inside of container 10, ridge 40 has a U shape. Thus, ridge 40 provides a U-shaped open channel for viscous liquid to drain into and flow out of container 10 to more efficiently drain the entire contents of container 10.

For gripping container 10, recesses 50 and 52 (not shown) are provided in front panel 16 and back panel 18, respectively. Recesses 50 and 52 are used as finger and thumb grips for holding container 10 while pouring. Recesses 50 and 52 are illustrated as dimples, but can take on a variety of configurations.

Turning now to FIGS. 5 and 6, a container 100 is illustrated as an alternative embodiment of the present invention. Like container 10, container 100 has a base portion 112 and a top portion 114, the base portion 112 comprising front and back panels 116 and 118, first and second side panels 120 and 122, respectively, and a bottom panel 124. Top portion 114 has a first wall 126, a second wall 128, a front wall 130 and a back wall 132. Top portion 114 has an opening 134 which serves as a mouth for container 100. A cap receiving portion 136 is formed integral with top portion 114, and a cap 138 provides a closure for cap receiving portion 136 and opening 134.

Container 100 has a transition corner 142, a ledge 144 and an extended neck portion 146. A ridge 140 is provided on second wall 128, and in this embodiment a transverse cross section of ridge 140 is triangular in shape. Ridge 140 is preferably centered between first and second side panels 116 and 118. A single, centered ridge 140 or 40 is preferred because a single, central ridge provides a good distribution of forces for top load compression strength and a single, central channel provides good drainage of fluid from the container. However, two or more ridges can be used.

A recess 150 is provided in front panel 116, and a recess 152 (not-shown) is provided in back panel 118 for gripping container 100. Recesses 150 and 152 illustrate the many variations possible for the shape of a recess for gripping the container.

Preferably, containers 10 and 100 hold either one U.S. quart or one liter of fluid. For holding one U.S. quart, the dimensions for container 10 are as follows. The width of front and back panels 16 and 18 between first and second side panels 20 and 22 is about four inches. The width of first and second side panels 20, 22 between front panel 16 and back panel 18 is preferably about 2 and ⅜ inches. The height of base portion 12 from bottom panel 24 to transition corner 42 is about 5 and ¾ inches. The vertical height from transition corner 42 to ledge 44 is about 3 and ⅜ inches, which is about 59% of the height of base portion 12 and is preferably at least about 40% of the height of base portion 12. The length of second wall 28 from transition corner 42 to ledge 44 is about equal to the width of front and back panels 16, 18, which is about four inches, although this length can vary between about 75% and 125% of this width. The walls are about one-sixteenth of an inch thick and are made preferably of high density polyethylene.

With container 10 standing upright as shown in FIG. 1, a projection of ridge 40 on a horizontal axis is approximately equal to a projection of ridge 40 on a vertical axis. With regard to the amount of curvature in ridge 40 and second wall 28, if a straight line 43 is drawn from transition corner 42 to ledge 44, then a maximum gap, $\alpha$, between a top portion of ridge 40 and the line is about ⅜ of an inch. As shown in FIG. 4, ridge 40 has a width, W, at its base and a height, H, from which it protrudes from an outside surface of second wall 28. W is typically between one and five times H, but in a preferred embodiment, W is equal to about three times H for containers 10 and 100. For the dimensions described above, W is about ⅜ths of an inch and H is about ⅛th of an inch. Second wall 28 at transition corner 42 is about as wide as first and second side panels 20, 22, which is about 2 and ⅜ inches. Thus, W is about 16% of the width of second wall 28, and W can range between about 5% and 50% of the width of second wall 28.

To use container 10 (the use of container 100 being analogous), a user grasps container 10 inserting a thumb and finger in recesses 50 and 52. Cap 38 is removed as is a seal (not shown) which seals the mouth of container 10. If the fluid in container 10 is motor oil for an engine, then an engine valve cover cap is removed to provide an engine opening through which the motor oil can be poured into the engine. As compared to a prior art container, top portion 14 is elongated which, along with the concave, arcuate shape of second wall 28, allows container 10 to be placed closer to the engine opening. First side panel 20 and first wall 26 are placed in an up position, so that air enters container 10 as fluid drains out. As container 10 empties, bottom panel 24 is moved into a higher position while the mouth remains in the engine opening.

On the inside of container 10, ridge 40 provides an open flow channel for fluid to drain into as container 10 empties. An open flow channel provides a reduced wetted area. Since ridge 40 provides an open flow channel, fluid can drain into the open channel and once in the open channel, friction between inside walls of container 10 and the fluid is reduced. The open channel accumulates and concentrates the flow into a single flow stream for drainage through the mouth. Because there is more friction between a fluid and a wall than between the fluid and itself, less friction is experienced by the fluid in the flow channel provided by ridge 40 than would be experienced if container 10 did not have ridge 40. This is of importance in discharging the final five or ten percent of the contents where the fluid tends to adhere to the wall and flow slowly. Consequently, fluid drains more quickly and efficiently from container 10 because it has ridge 40.

Ridge 40 also serves as a structural support for strengthening container 10 against top load compression. For example, motor oil is bottled in container 10, and a number of containers 10 are placed in a cardboard box to form a case. Cases are stored in a warehouse and are stacked one on another. As many as forty cases may be stacked vertically. Container 10 must be able to withstand the compressive force of the weight above it. Ridge 40 adds the structural strength to container 10 necessary to withstand this top load.

In a top load compression test, weight is applied to cap receiving portion 36 until container 10 begins to deform. At the point of initial deformation, the force applied is recorded as the top load compression strength of container 10. The shape of container 100, without ridge 140 and recess 150, is similar to a prior art motor oil container. Top load compression strength of container 10 has been compared to such a prior art motor oil container. A total of 580 prior art containers were tested for top load compression strength. The average load that the prior art containers could withstand before deformation was 62.0 psi. Top load compression strength ranged from a minimum value of 40 psi to a maximum value of 98 psi with a standard deviation of 11.5 psi. On the other hand, containers embodying the elements of the present invention had an average top load compression strength of 65.5 psi, where a total of 556 containers were tested. The top load compression strength ranged from 40 to 92 psi, with a standard deviation of 9.9 psi. The containers embodying elements of the present invention had a more elongated neck than the prior art containers, but yet could withstand a top load compression of 65.5 psi versus 62.0 psi for the prior art containers. Thus, surprisingly, although the neck was more elongated, containers having elements of the present invention were not only as strong as the prior art containers, but even had a somewhat higher (65.5 versus 62.0 psi) average top load compression strength than the prior art containers.

Confirming that it is ridge 40 (or 140) that provides structural strength, tests were run comparing a container shaped like container 10, but without ridge 40, to a container having the elements of the present invention. The top load compression strength of the container without ridge 40 was about one-half that of the container having the elements of the present invention. In other words, the top load compression strength of container 10 is approximately double that of a container having the same shape as container 10 but without ridge 40. Without ridge 40, second wall 28 tends to bend inwards when force is applied downwards on cap receiving portion 36. However, with ridge 40, a compression load applied to cap receiving portion 36 is distributed along ridge 40 to transition corner 42 and second side panel 22. Thus, ridge 40 reduces the tendency of second wall 28 to crumple inward when force is applied downward on cap receiving portion 36.

In summary, the present invention is advantageous for several reasons. Ridge 40 provides a structural member for improving top load compression strength of container 10. With this feature, container 10 can withstand the rigors of warehousing where as many as forty cartons may be stacked one on another in a vertical column. The containers at the bottom must be able to withstand the weight of the containers above, and container 10 has the capability to do that because ridge 40 adds structural strength. The elongated neck and concave, arcuate structure of second wall 28 improves the accessibility of container 10 to an engine opening for emptying the contents of the container. This feature is particularly important in engines where accessibility to the engine opening is limited, making it difficult to add motor oil or automatic transmission fluid without spillage. Ridge 40 from the inside of the container provides an open flow channel for improving discharge of the fluid from the container when the container is nearly empty. Viscous fluid adheres somewhat to the inside walls of the container, but fluid channeled into the open flow channel provided by ridge 40 flows more readily because there is less friction within a flowing fluid than between fluid and the inside walls. Recesses 50 and 52 provide thumb and finger grips for grasping container 10, and recesses 50 and 52 inherently instruct the user to place first side panel 20 in an up position when first emptying the container. In this manner air enters container 10 as container 10 is held in a somewhat horizontal position while it is nearly full of fluid, but while the fluid is being discharged. Air flows inward along an inside surface of first wall 26 and first side panel 20 and replaces the fluid as the fluid is discharged from container 10.

Modifications and alterations to the embodiments disclosed herein will be apparent to those skilled in the art in view of this disclosure. However, it is intended that all such variations and modifications fall within the spirit and scope of this invention as claimed.

What is claimed is:

1. A container, comprising:

a bottom panel;

a front panel, a back panel, a first side panel and a second side panel, each extending integrally from the bottom panel; and an inverted offset funnel extending integrally from the front, back, first side and second side panels, the funnel having:

an opening at a top portion for forming a mouth, a first wall substantially aligned with the first side panel, and a second wall extending from the second side panel to the mouth, the second wall having a ridge that extends from the second side panel to the mouth, said ridge defining a flow channel that extends continuously within the container from the second side panel to substantially adjacent the mouth, the ridge having a concave arcuate shape as viewed from the outside of the container.

2. The container of claim 1, wherein the second wall has an arcuate shape.

3. The container of claim 1, wherein the ridge extends from the second side panel to substantially adjacent the mouth.

4. The container of claim 1, wherein the ridge is formed by bends in the second wall.

5. The container of claim 1, wherein the ridge has an inverted U shape cross-section defining a channel within the container.

6. The container of claim 1, wherein the ridge has a triangular shape cross-section defining a channel within the container.

7. The container of claim 1, wherein the ridge has a width, W, at its base and a height, H, protruding from an outside surface, W being between about one and five times H.

8. The container of claim 7, wherein W is equal to about three times H.

9. The container of claim 1, wherein the front panel and the back panel have a width, W1, and the second wall has a length, L, wherein L is between about 75% and 125% of W1.

10. The container of claim 1, wherein the longitudinal axis of the ridge is approximately aligned with the longitudinal axis of the second wall.

11. The container of claim 1, wherein the ridge has a width, W, at its base and the second wall has a width, W2, wherein W is between about 5% and 50% of W2.

12. The container of claim 1, wherein the front and back panels have recesses for gripping the container.

13. A container, comprising:

a base portion having a substantially rectangular cross section, the base portion being open at an upper end and suitable for holding a fluid, the base portion having a first side and an opposing second side; and a top portion formed integral with the upper end of the base portion, the top portion having:

a container opening forming a mouth for the container, the mouth being offset so that an outside edge of the mouth is in substantial alignment with the first side of the base portion, a top panel extending from the second side of the base portion to the mouth, the top panel having a concave arcuate shape as viewed from the outside of the container, and a ridge formed in and along the length of the top panel for increasing the top load strength of the container, the ridge defining a flow channel having a first end disposed in fluid communication with the upper end of the base portion and a second end substantially adjacent the mouth and in fluid communication with the container opening.

14. The container of claim 13, wherein the peak of the ridge is approximately aligned with a longitudinal axis of the top panel.

15. The container of claim 13, wherein the top panel has a concave, arcuate shape.

16. The container of claim 13, wherein the top panel is essentially straight along its length.

17. The container of claim 13, wherein the base portion has a height along its longest dimension, and the top portion has a height aligning with the height of the base portion, wherein the height of the top portion is at least about 40% of the height of the base portion.

18. The container of claim 13, wherein the base portion has a height along its longest dimension, a thickness along its shortest dimension and a width along an intermediate dimension, wherein the top panel has a length along its perimeter, and wherein the length of the top panel is between about 75% and 125% of the width of the base portion.

19. The container of claim 13, wherein a transverse cross section of the ridge has an inverted U shape.

20. The container of claim 13, wherein the base portion has a height along its longest dimension and a thickness along its shortest dimension, wherein the ridge has a width, W, at its base, and wherein W is between about 5% and 50% of the thickness of the base portion.

21. The container of claim 13, wherein the ridge has a width, W, at its base and a height, H, protruding from an outside surface, and wherein W is between about two and five times H.

22. The container of claim 13, further comprising a cap receiving portion formed integral with the top portion, the cap receiving portion having an opening in substantial alignment with the opening of the top portion.

23. The container of claim 13, wherein the base portion and the top portion have a common front panel and an opposing back panel, wherein the front panel, and the back panel have a recess for gripping the container, wherein the recess is proximate to the first side.

24. The container of claim 3, wherein the ridge has side walls extending continuously from the second side panel to substantially adjacent the mouth, the sidewalls at least partially defining the flow channel.

25. The container of claim 13, wherein the first end of the flow channel is in direct open communication with the upper end of the base portion.

26. A liquid container, comprising:

a base portion having a bottom panel and side walls, each extending integrally from the bottom panel, the base portion being open at an upper end to define a main liquid compartment portion; and an inverted offset funnel extending integrally from the side walls, the funnel having:

a top portion having an opening that forms a mouth, a first wall substantially aligned with a section of the side walls, and a second wall extending from a second section of the side walls to the top portion, the second wall having at least one ridge extending between the second side panel and the top portion, the ridge defining a flow channel having a concave arcuate shape as viewed from the outside of the container.

27. The container of claim 26, wherein the ridge is adapted to increase top load strength of the container.

28. The container of claim 26, wherein the flow channel has a first end in direct open communication with the upper end of the base portion.

29. The container of claim 28, wherein the flow channel has a first end in direct open communication with the upper end of the base portion, and a second end substantially adjacent the mouth.

30. The container of claim 26, wherein the flow channel extends continuously from the second section to substantially adjacent the mouth.

31. The container of claim 26, wherein the side walls have recesses adapted to facilitate gripping of the container.

32. The container of claim 26, wherein the first end of the flow channel is disposed in direct fluid communication with the main compartment portion.

33. A container for holding and dispensing a liquid, said container comprising:

a base portion having a bottom panel, a front panel, a back panel, a first side panel and a second side panel extending integrally from the bottom panel, the base portion being open at an upper end to form a main liquid compartment thereunder; and an inverted offset funnel extending integrally from the front, back, first side and second side panels, the funnel having:

an opening at a top portion for forming a mouth, a first wall substantially aligned with the first side panel, and a second wall extending from the second side panel to the mouth, the second wall having at least one ridge for increasing the top load strength of the container, the ridge defining a flow channel having a concave arcuate shape as viewed from the outside of the container and extending continuously from the second side panel to substantially adjacent the mouth, wherein the flow channel has a bottom end disposed in direct open fluid communication with the upper end of the base portion and the main compartment.

* * * * *